United States Patent [19]

Wilder

[11] 3,976,139

[45] Aug. 24, 1976

[54] ANCHORING FOR TENSIONING CASING IN THERMAL WELLS

[75] Inventor: Lawrence B. Wilder, Tulsa, Okla.

[73] Assignee: Standard Oil Company (Indiana), Chicago, Ill.

[22] Filed: Dec. 30, 1974

[21] Appl. No.: 537,168

[52] U.S. Cl. ..... 166/285; 166/177; 166/214

[51] Int. Cl.[2] ..... E21B 43/25; E21B 33/00

[58] Field of Search ..... 166/285, 315, 120, 177, 166/212, 136, 214, 242

[56] References Cited

UNITED STATES PATENTS

| | | | |
|---|---|---|---|
| 2,960,165 | 11/1960 | Schramm | 166/214 |
| 3,055,424 | 9/1962 | Allen | 166/242 |
| 3,324,389 | 6/1967 | Blank, Jr. | 166/136 |
| 3,374,836 | 3/1968 | Gribbin | 166/214 |
| 3,545,543 | 12/1970 | Kammerer, Jr. | 166/212 |
| 3,777,819 | 12/1973 | Delano | 166/285 |

*Primary Examiner*—James A. Leppink
*Attorney, Agent, or Firm*—John D. Gassett

[57] ABSTRACT

This invention relates to an improved method of cementing casing in a well where the casing string will subsequently be heated by the injection of steam or the flowing of other hot fluids through the casing. Long vertical anchor bars are positioned about the lower portion of the casing string. Lower holding means retains the lower ends against the casing string. Likewise, upper holding means holds the upper end against the casing. Means are provided for releasing the upper holding means and for forcing the upper ends of the anchor bars outwardly so that they engage and anchor against the borehole wall. Prior to the anchoring of the anchor bars, cement is circulated down through the casing string and up the annulus between the casing and the borehole wall, and during this time the casing can be rotated or moved up and down in accordance with good casing cementing practice. After the cement has all been circulated into the casing-well annulus, the anchors are set and the casing is pulled upwardly under tension and is held under tension until the cement sets.

5 Claims, 10 Drawing Figures

ANCHORING FOR TENSIONING CASING IN THERMAL WELLS

BACKGROUND OF THE INVENTION

1. Field of the Invention

This invention relates to method and apparatus of cementing a casing in a wellbore in which the casing will subsequently be heated to a higher temperature, causing it to want to elongate. It particularly concerns an apparatus whereby the cement can be circulated using conventional optimum methods and then anchoring the lower end of the casing and applying upward tension to the casing until the cement is set.

2. Setting of the Invention

In the search for oil and gas, boreholes are drilled deep into the earth. These holes are lined with casing, which is usually heavy steel pipe, and cement is forced between the casing and the borehole wall. In most cases, the fluid flowing through the wellbore is such that the temperature of the casing doesn't vary much from what it is when it is originally set. However, in a growing number of situations, the fluid flowing through the wellbore is of such a high temperature that the casing is heated to a much higher temperature from that which it was when the casing was set. This is true of thermal wells. A thermal wall can be a well in which steam or other hot fluid is injected down through a tubing string suspended in the wellbore to aid in recovery of fluid from the underground formation, or it can be produced fluid from a formation which has a very high temperature. The increased temperature causes the casing to try to elongate. It has been found that if the casing is hung and cemented and large temperature differences are added to the casing, the tensile stress reduction for the fixed cemented casing is approximately 200 psi per degree Fahrenheit change.

In conventionally cementing a casing string in a wellbore, the casing string is reciprocated and rotated during the placing or circulation of the cement between the outer wall of the casing and the wellbore. The present invention permits conventional placing of cement and then placing the casing under extra tension while the cement sets. The extra-tensile stressing of the casing is thus retained after the cement sets. This extra-tensile stressing prevents heat from causing destructive compressive stresses in the casing once hot fluids are passed therethrough.

3. Prior Art

The closest prior art with which I am familiar is U.S. Pat. No. 3,545,543, Archer W. Kammerer, Jr., and Gary R. Johnson, issued Dec. 8, 1970, for "Casing Apparatus and Method for Tensioning Casing Strings." That patent concerns a method of pre-tensioning the casing string and cementing it in place while its tension condition is retained. However, the method described in that patent has two requirements or disadvantages which the present invention does not have. The method of that patent requires forming a downwardly facing shoulder in the well-bore formation at the lower end of the wellbore; this hole enlargement process is commonly called "under reaming." That patent also teaches to anchor the lower end of the casing and then place the cement between the casing and the borehole wall. This anchoring prior to the placing of the cement prevents the casing from being reciprocated and rotated as is desired in conventional cementing.

The instant invention described herein has a different anchoring system and permits cement to be placed in the conventional manner including the reciprocating and rotating of the casing string prior to anchorage at the lower end of the casing and subsequently applying tension. The present invention also does not require any under reaming for its anchoring.

BRIEF SUMMARY OF THE INVENTION

This invention concerns a system and apparatus whereby casing is extra-tension stressed before the cement hardens. It includes placing cement between the casing and the borehole wall and can include reciprocating and rotating the casing in accordance with good engineering practices while the cement is being circulated. After the cement is thus circulated, the lower end of the casing is firmly anchored to the subsurface formation, and then extra tension is applied at the surface until the cement sets, thus obtaining an extra-tension stressed casing. The apparatus for accomplishing this includes an anchoring apparatus attachable to the lower portion of the string of casing and having anchor members with upper ends for engaging and anchoring to the borehole wall and having lower ends positioned about the lower portion of the string of casing. Lower holding means retains the lower ends of the anchor bar members to the lower portion of the casing string. Upper holding means hold the upper end adjacent the lower portion, and means are provided for releasing the upper holding means and for urging the upper ends of the anchor members out against the formation wall for anchoring the casing string. This manipulation is done from the surface.

BRIEF DESCRIPTION OF THE DRAWINGS

A better understanding of the invention and various modifications and objects thereof can be made from the following description taken in conjunction with the drawings in which.

DETAILED DESCRIPTION OF THE INVENTION

Figure 1:
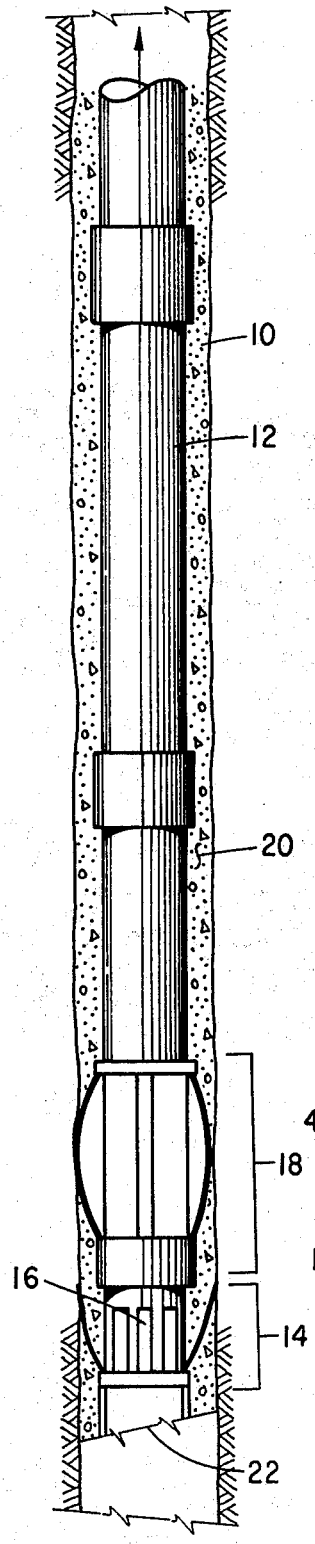
FIG. 1 is a full face view of the apparatus of the invention placed in a casing string in the lower portion of a wellbore.

Attention is first directed to FIG. 1, which shows a casing string 12 suspended in a borehole 10 which is drilled in the earth. An anchor section 14, having anchor bar 16, is positioned on a lower portion of the casing. A spring centralizer 18 is positioned just above the anchor 14. In the arrangement shown in FIG. 1, cement fills the annular space 20 between the casing 12 and the wall of the borehole 10. In operation, after the borehole 10 has been drilled, the casing with the attachment shown thereon is lowered in the wellbore to its desired position. Then, cement is circulated down through the interior of casing 12, around and up past the bottom end 22, and up annulus 20. Then, during the circulation of the cement up annulus 20, casing 12 may be reciprocated and rotated in accordance with good engineering practices to obtain a good cement job. As soon as the desired amount of cement has been placed in annulus 20, anchors 16 are set and the casing string 12 placed under extra tension and held under extra tension until the cement has hardened or set to obtain extra-tensioned casing. FIG. 1 shows the system with the anchors set.

Figure 2:
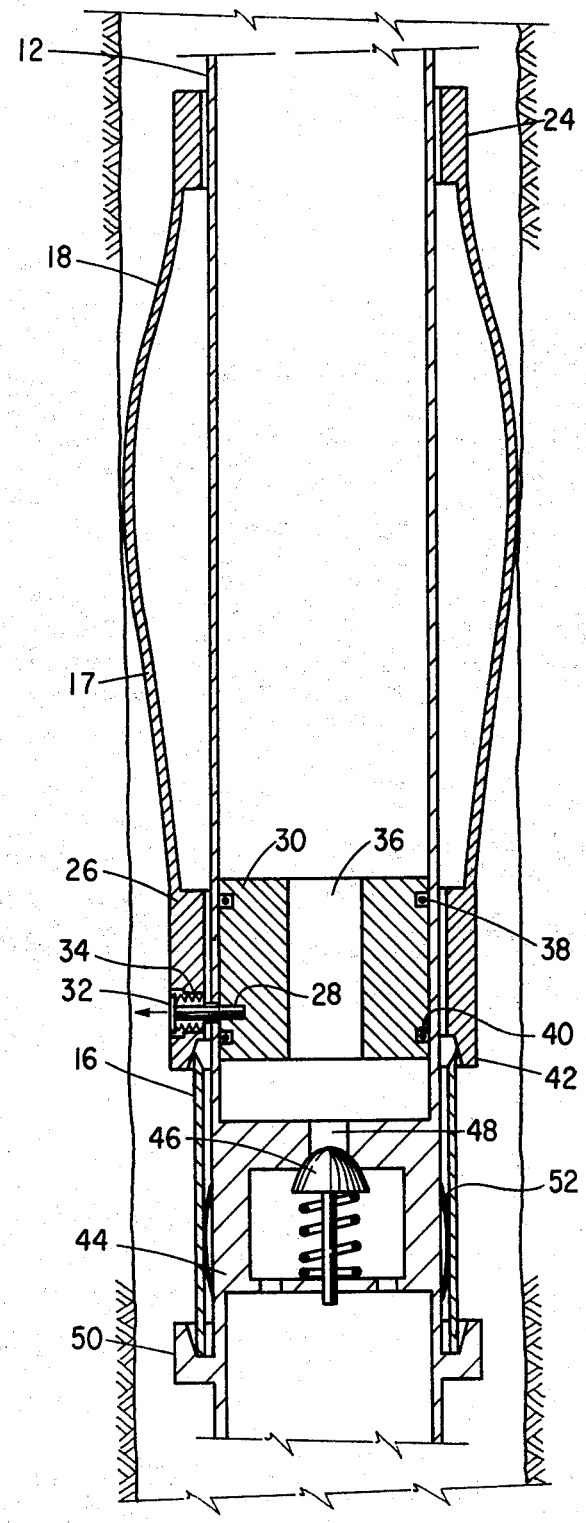
FIG. 2 is an enlarged cutaway view, mostly in section, showing one embodiment of the anchoring mechanism of my invention.

Attention is next directed to FIG. 2, which shows an enlarged view of the anchoring system before anchoring. Shown there is centralizer 18, with a bow spring 17, an upper ring 24, and a lower ring 26. These rings 24 and 26 are sometimes movable, both longitudinally and rotationally with respect to casing 12. However, in this case, the ring 26 has been modified so that it is prevented from having relative movement with casing 12 by shear pin 28. Shear pin 28 extends through casing 12 and into piston 30, which is mounted inside casing 12. The inner end of shear pin 28 is secured to piston 30. The outer end of shear pin 28 has a head 32, which is being urged outwardly by springs 34. Piston 30 has a longitudinal passageway 36 therethrough and is sealed by upper seals 38 and lower seals 40 with the interior of casing 12. Until it is sheared, shear pin 28 prevents piston 30 from moving with respect to casing 12. The lower end of lower ring 26 of centralizer 18 has an outwardly extending lip 42. This is to hold or retain anchor bar 16 in a non-anchoring position adjacent the casing 12. This is also as long as shear pin 28 is not sheared and the ring 26 remains in the relative position shown in FIG. 2.

A float collar 44 is provided at the lower end of the casing string 12 and is provided with a passage 48 and a check valve 46. The conventional float collar has been modified to have means for holding the lower end of anchor bar 16 in position adjacent the casing 12, or its extension, float collar 44. This includes upwardly facing cup or ring means 50. As can be seen in FIG. 2, then, longitudinal bars 16, which are to be used as anchoring means, are held in position by lower cup 50 and upper cup 42, so long as shear pin 28 holds the ring 34, the centralizer, in the position shown.

Figure 3:
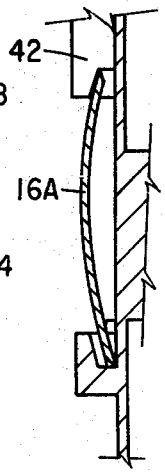
FIG. 3 is an enlarged view of one of the anchor bars of FIG. 2.

Anchor bars 16 are urged outwardly. This can be accomplished, as shown in FIG. 2, by bow springs 52, and alternatively as in the manner shown in FIG. 3. In FIG. 3, the spring bars 16A are constructed with an initial bend so that when the upper retaining collar or cup 42 is removed, the top of the bars will spring outwardly and engage the wall of the hole.

Figure 4:
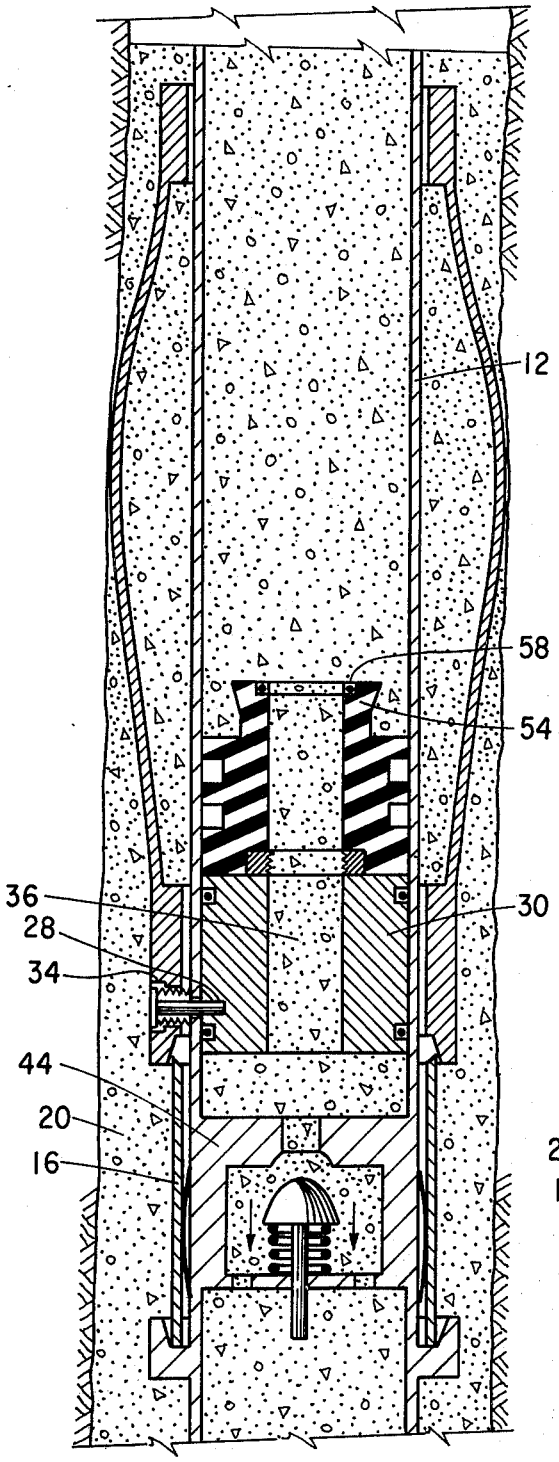
FIG. 4 is similar to FIG. 2, except it shows the tool having cement circulated therethrough, and including a cementing bottom plug.

FIG. 4 is quite similar to FIG. 3, except that a bottom cementing plug 54 is shown. Plug 54 is placed in the casing just ahead of the cement and wipes the casing clean with its wipers as it moves down the pipe. When this plug reaches the piston 30, the differential pressures rupture the rubber diaphragm 58 at the top of the plug, and allows the cement slurry to proceed down through the plug, passage 36 in piston 30, through float collar 44, and up the annular space 20 between the casing 12 and the borehole wall. It will be noted at this stage that shear pin 28 has not been sheared and that the anchors 16 are not anchoring. This permits the cement to be circulated and the pipe rotated and reciprocated to obtain a good cement bond between the casing 12 and the borehole wall.

Figure 5:
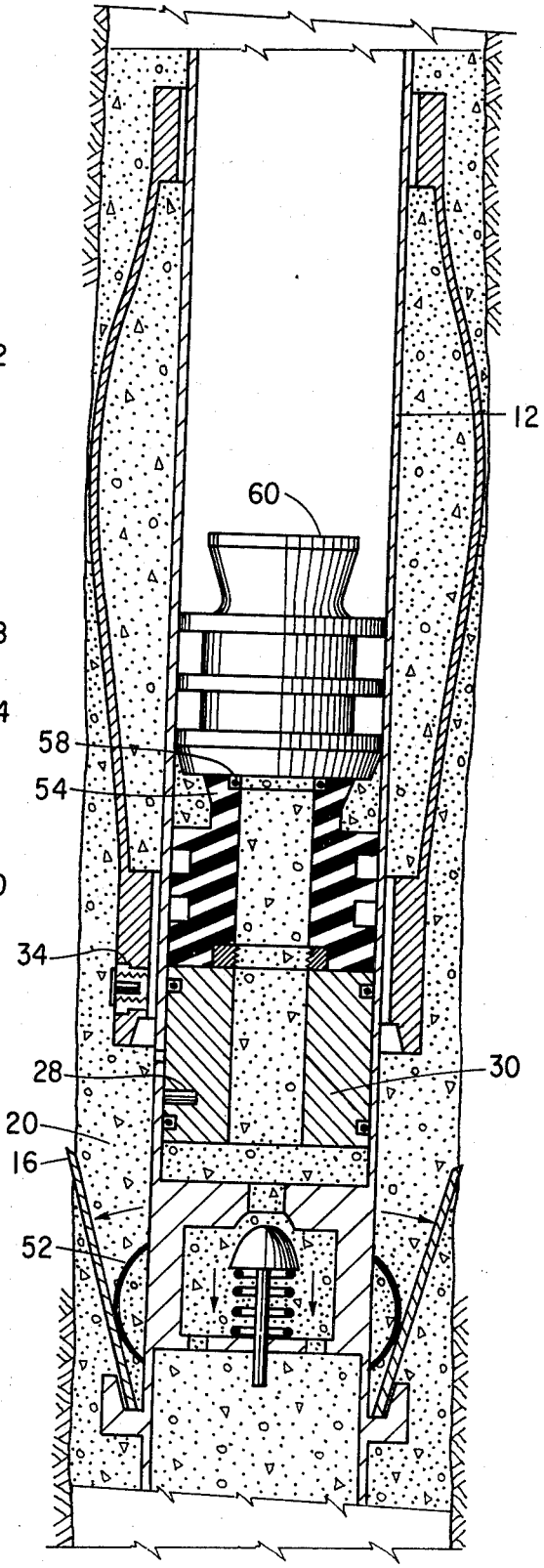
FIG. 5 shows the apparatus of FIG. 4 after the cement has been placed in position and the anchor bars are anchoring.

FIG. 5 shows the device with the anchors 16 firmly anchored to and engaging the borehole wall. What has happened here is that when the correct amount of cement has been placed in casing 12, a top plug 60 is inserted. Then, a driving fluid, such as water, forces the top plug 60 and the cement beneath it downwardly until all the cement above bottom plug 58 is displaced. The top plug 60 comes to rest on bottom plug 58, as shown in FIG. 5. Sufficient pressure is applied to the fluid above the top plug 60 so that shear pin 28 is sheared and the plug 30 comes to rest on the top of float shoe 44. When this occurs, the shear pin 28 is removed from casing 12 by springs 34 and centralizer 18 is no longer attached directly to the casing. At this point, the casing is lowered slightly but centralizer 18 remains in position because of drag between the bow springs 17 and the borehole wall. This permits bar 16 to be urged or snapped outwardly against the wall of the borehole. An upward pull then on the casing causes the anchor 16 to be firmly embedded in the borehole wall, thus anchoring the lower end of the casing. By observation of casing tension at the surface, the driller can tell easily if the lower end of the casing is actually anchored. Then the desired additional tension is applied to the casing 12 and held there until the cement sets. One then has an extra-tensioned cemented casing string. One can by simply using good engineering practices calculate the amount of tension needed by estimating or determining otherwise the actual rise in temperature to which the casing will be subjected.

Spring bars 16 can be made of high strength alloy steel so that collectively they can have a compressive strength that is equal to or greater than the tensile strength of the casing. The spring bars can also be sharpened on the edge contacting the formation to assist in digging into the formation. Even very hard formations exhibit a rough surface due to the drill bit action, so there is little likelihood that the anchors would not develop sufficient bite. In very soft formations, of course, the anchors would simply plow enough formation to wedge and develop the necessary anchoring power.

Attention is next directed to FIGS. 6, 7, 8, 9 and 10 which illustrate an alternate anchor setting mechanism. Attention is first directed especially to FIG. 6, although the other figures have the same reference numbers. Shown therein is a piston 70 having a longitudinal bore 72 therethrough set in the lower end of casing 12. Piston 70 is held in position by shear pin 78 which functions very similar to shear pin 28 of FIG. 2, for example, Shear pin 78 holds piston 70 to collar 76 which is attached to casing 12. A suitable seal 71 is provided between the two.

A lug 74 extends through window 80 in collar 76. The inner part of lug 74 is anchored within piston 70 and the outer portion of the lug connects to an expander sleeve or circular member 75, shown in FIG. 10. Ring 72 has a downwardly and inwardly sloping shoulder 82 and sleeve 90. The lower end of sleeve 90 has a slotted extension 85 which has a space or cavity 87 between the extension 85 and the lower extension of collar 76. Extension 85 thus acts as a spring extension arm. A seal 91 is provided between the lower end of piston 70 and the lower portion of collar 76. Collar 76 is also provided with an upwardly facing internal shoulder 88 to limit the downward movement of piston 70.

Figure 6:
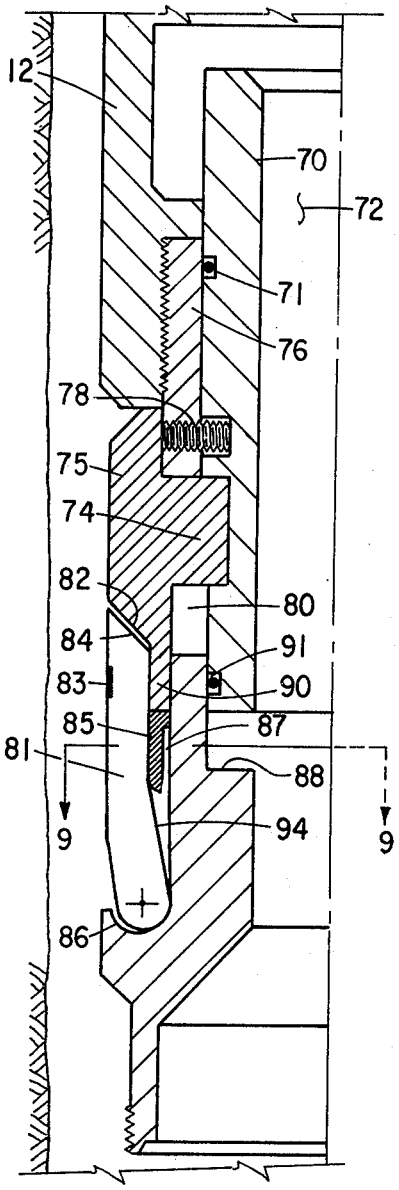
FIG. 6 illustrates in section an alternate anchoring setting embodiment of the tool.
Figure 7:
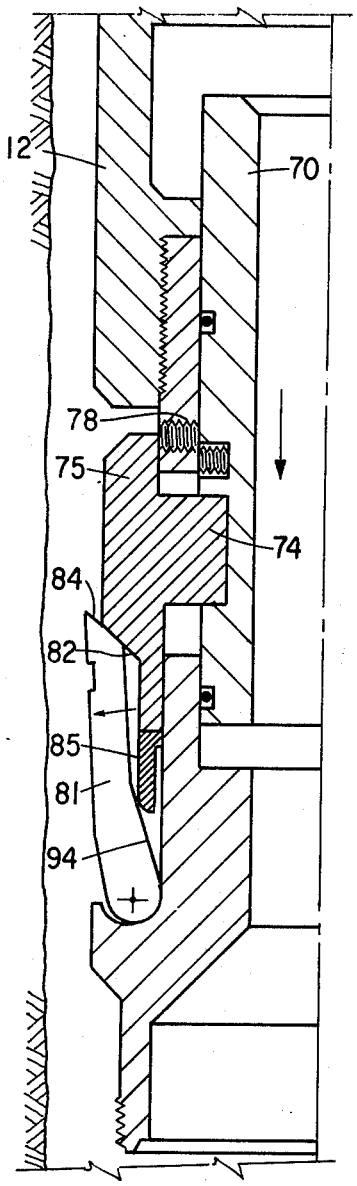
FIG. 7 is similar to FIG. 6 which shows the anchors partly extended.
Figure 8:
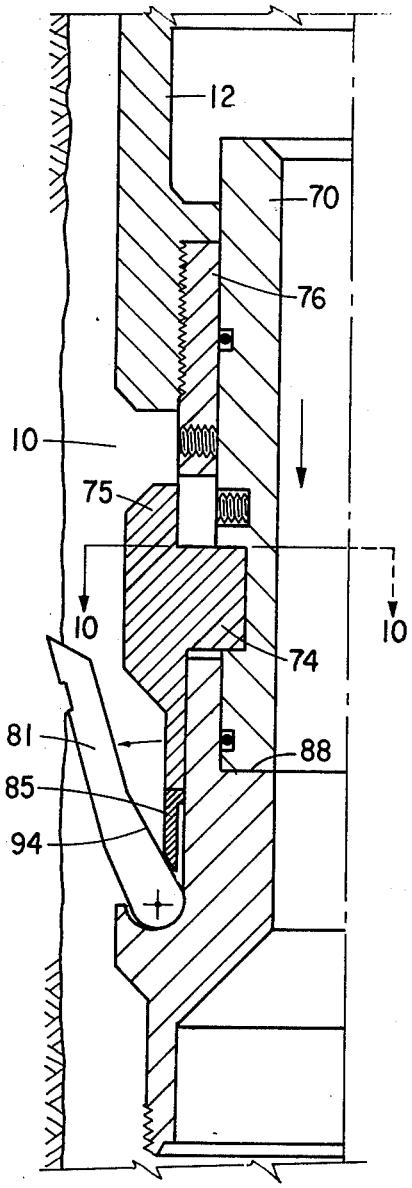
FIG. 8 is a sequence to FIG. 7 and shows the anchors in anchoring position.
Figure 9:
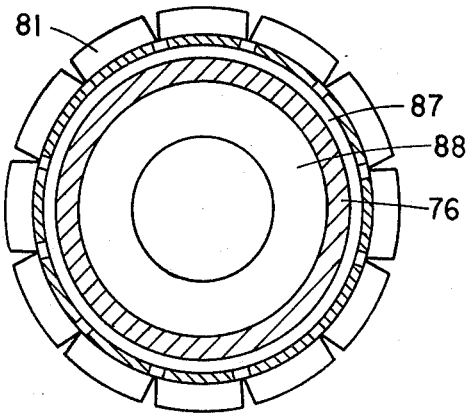
FIG. 9 is a section along the line 9—9 of FIG. 6.
Figure 10:
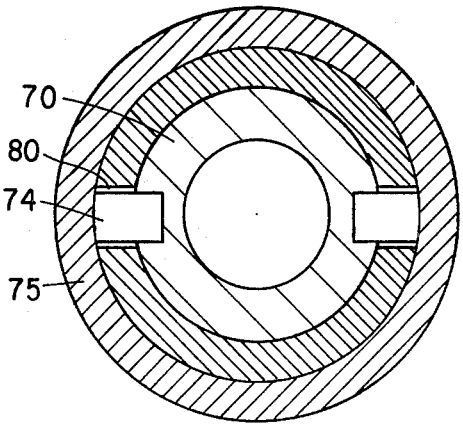
FIG. 10 is a section along the line 10–10 of FIG. 8.

A plurality of anchor bars 81 is spaced around the lower end of collar 76 which has an upwardly facing receiving cup 86. The lower end of bars 81 are rounded and are held in cup 86. The plurality of anchor bars 81 are initially held in position by band 83. Band 83 is frangible and its only purpose is to hold the bars 81 in the position shown in FIG. 6 until it is time to set them. As best seen in FIGS. 6, 7 and 8 the upper end of bars 81 has an upwardly and outwardly facing upper shoulder 84. Ring 75 has a downwardly facing shoulder 82 which is arranged to contact upper shoulder 84 on downward movement of ring 75.

Faces 84 of anchor bar 81 and 82 of the ring 75 complement each other. The angle shown, and one which is believed most suitable, is about 45 degrees with the centerline of the tool. The anchor bar 81 has a more tapered shoulder 94 which makes a much steeper angle with the centerline of the tool. A typical angle for this shoulder is about 10 degrees.

The cementing operation of the tool embodiment in FIGS. 6, 7 and 8 is carried out the same as the cementing of the tool in FIGS. 2, 4 and 5. When the desired amount of cement has been injected into casing 12, a plug is inserted and additional pumping causes it to rest on top of piston 70 the same as piston 30 of FIG. 2. When the plug reaches the piston 70, it will be forced down just like piston 30 was in the embodiment of FIG. 2. This downward movement of piston 70 will shear shear pin 78 and further the downward movement of piston 70 will carry ring 75 and lug 74 with it, and the bar 81 will be forced outwardly breaking band 83. The progress at this stage is shown in FIG. 7. It can be seen there that face 84 of the bar and face 82 of the lug 74 are in sliding contact and the anchor bar 81 is being forced outwardly. Shortly before face 84 and face 82 lose contact due to outward movement of anchor bar 81, the spring arm extension 85 contacts tapered shoulder 94 of bar 81.

FIG. 8 shows a further stage caused by additional downward movement of piston 70. This shows the lowermost movement of piston 70 which has come to rest on shoulder 88, and at this point the anchor bar 81 has been pushed to its outer position and an upward pull has caused the outer end of the bar 81 to anchor firmly into the wall of the borehole 10. Spring extension arm 85 forces the anchor bars 81 outwardly but with a slight spring effect. This, coupled with the sloping surface face 94 of the anchor bar, causes all of the anchor bars 81 to be extended against the borehole wall, regardless of wall irregularities. Anchor bars 81 also centralize the casing 12 in the borehole 10 so that the annular cement sheath will have a uniform thickness. Tension is then held on casing 12 until the cement (not shown in FIGS. 6, 7, or 8) between the casing and the borehole wall has set. The end result of this is the same as in the device of FIG. 2 in that the cemented casing string has extra tension.

While the above invention has been described in detail, various modifications can be made therefrom without departing from the spirit or scope of the invention.

What is claimed is:

1. A method of extra-tensioning a string of casing to be cemented in a borehole drilled in the earth and wherein fluids will flow through said casing at a temperature greater than the initial temperature of said casing which comprises:

circulating cement down the interior of said casing and up the annulus between the outer wall of the casing and the bore-hole wall;

rotating and reciprocating the casing in the borehole wall, at least after a substantial portion of said annulus has been filled with cement;

after such reciprocation and rotation and cement placement, anchoring the lower end of said string of casing to said borehole wall; and thereafter, but before said cement has set, applying a tension to said string of casing and maintaining said tension until said cement has set.

2. An anchoring apparatus attachable to the lower portion of a string of casing suspended in a wellbore which comprises:

a. anchor members having lower ends and upper ends, said upper ends for anchoring to the borehole wall, said anchor members positioned about the lower portion of said string of casing;

b. lower holding means for retaining the lower ends of said anchor members to said lower portion of said casing string;

c. upper holding means for holding the upper ends adjacent to said lower portion, such means including a centralizer slideably mounted on said portion of said casing; and d. means operable from the surface for releasing said upper holding means so that said upper ends of said anchor members are urged outwardly and including a piston in said string of casing and a shear pin extending from said piston through said portion of said string to the lower end of said centralizer and means urging said pin outwardly.

3. An anchoring apparatus attachable to the lower portion of a string of casing suspended in a borehole which comprises:

anchor bars positioned about the lower end of said casing, the upper end of each of said anchor bars sloping downwardly toward the inner side and the lower ends being rounded;

holding means supported by said casing and shaped to receive the lower ends of said anchor bars;

an expander sleeve positioned about said casing and having a segmented lower extension for each anchor bar, the end portion of each extension being undercut on the inner side;

frangible upper holding means for holding the upper ends of said anchor bars adjacent said casing; and means for moving said expander sleeve downwardly.

4. An anchoring apparatus as defined in claim 3 in which said means for moving said expander sleeve downwardly includes a piston within the lower end of said string of casing.

5. An anchoring apparatus, as defined in claim 3, in which said means for moving said expander sleeve downwardly includes a window in said casing adjacent said expander sleeve, a piston member within said lower portion of a string of casing, and lug means extending through said window connecting said expander sleeve and said piston member.

* * * * *